US006637866B1

(12) United States Patent
Cornell et al.

(10) Patent No.: US 6,637,866 B1
(45) Date of Patent: Oct. 28, 2003

(54) ENERGY EFFICIENT HEATER STACK USING DLC ISLAND

(75) Inventors: Robert Wilson Cornell, Lexington, KY (US); George Keith Parish, Winchester, KY (US); James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 51 days.

(21) Appl. No.: 10/165,534

(22) Filed: Jun. 7, 2002

(51) Int. Cl.[7] ..... B41J 2/05
(52) U.S. Cl. ..... 347/64; 347/67
(58) Field of Search ..... 347/20, 56, 62, 347/63, 61, 65, 64, 67

(56) References Cited

U.S. PATENT DOCUMENTS

| | | | | |
|---|---|---|---|---|
| 4,663,640 A | | 5/1987 | Ikeda | 347/63 |
| 4,990,939 A | * | 2/1991 | Sekiya | 347/62 |
| 5,348,909 A | * | 9/1994 | Stasiak | 347/64 |
| 6,046,758 A | | 4/2000 | Brown et al. | 347/203 |
| 6,126,277 A | | 10/2000 | Feinn et al. | 347/65 |
| 6,139,131 A | | 10/2000 | Prasad et al. | 347/63 |

FOREIGN PATENT DOCUMENTS

| | | | | |
|---|---|---|---|---|
| EP | 906828 A2 | * | 8/1998 | B41J/2/14 |
| EP | 0 906 828 A2 | | 7/1999 | B41J/2/14 |

* cited by examiner

*Primary Examiner*—Thinh Nguyen
*Assistant Examiner*—Juanit Stephens
(74) *Attorney, Agent, or Firm*—David E. LaRose; Jacqueline M. Daspit

(57) ABSTRACT

The present invention is directed toward an improved heater chip for an ink jet printer. The heater chip has a diamond-like-carbon coating that functions as the cavitation and passivation layers of the heating elements on the heater chip. To improve the efficiency of the heater chip, the diamond-like-carbon coating is surrounded by a material that has a lower thermal conductivity than diamond. This surrounding layer limits thermal diffusion from the heating elements into the heater chip. A smoothing layer of tantalum is deposited over the diamond-like-carbon layer to insure that vaporization of the ink occurs at the ink's superheat limit. The diamond-like-carbon layer is preferably less than 8700 Angstroms in thickness such that less than 1 microjoule of energy is required to expel of ink droplet having a mass between 2–4 nanograms.

26 Claims, 4 Drawing Sheets

ENERGY EFFICIENT HEATER STACK USING DLC ISLAND

FIELD OF THE INVENTION

The present invention is generally directed to an improved printhead for an ink jet printer. More particularly, the invention is directed toward the use of diamond-like-carbon (DLC) to improve the energy efficiency of an ink jet printhead and to protect the relatively delicate thin film resistors of the printhead from corrosive inks and cavitation damage.

BACKGROUND OF THE INVENTION

A thermal ink jet printer forms an image on a printing surface by ejecting small droplets of ink from an array of nozzles on an ink jet printhead as the printhead traverses the print medium. The ink droplets are formed when ink in contact with a thin film resistive heating element is nucleated due to the heat produced when a pulse of electrical current flows through the heating element. The vaporization of a small portion of the ink creates a rapid pressure increase that expels a drop of ink from a nozzle positioned over the resistive heating element. Typically, there is one resistive heating element corresponding to each nozzle of the array. The resistive heating elements are activated under the control of a microprocessor in the printer electronics of the ink jet printer.

Electrical pulses applied to the heating elements must be sufficient to vaporize the ink. Any energy produced by the resistive heating element of an ink jet printer that is not absorbed by the ink ends up being absorbed by the heater chip. Hence, the total energy applied to the heating element includes the energy absorbed by the chip. This excess energy may result in an undesirable and potentially damaging overheating of the printhead if it is not properly dissipated. Furthermore, because it is desirable to produce an image as quickly as possible, there is a continual push in the ink jet printer industry to increase the number of drops expelled per unit of time. Unfortunately, as the number of nozzle fires in any given amount of time increases, the heat that must be dissipated by the printhead heater chip increases. If the printhead heater chip becomes too hot, the delicate semiconductor structures in the chip may be damaged. Therefore, it is desirable to transfer heat from the resistive element to the ink as efficiently as possible.

Cavitation is another phenomena that may adversely affect the performance of an ink jet print head. Cavitation occurs when, after an ink droplet has been expelled, the ink bubble forcefully collapses back down upon the resistive heating element. This impact can result in a large amount of stress being placed on the surface of the resistive heating element. In fact, this cavitation is so strong that it may actually crack or pit the surface of the resistive heating element and cause it to malfunction. In addition to the cavitation problem, many of the inks used by ink jet printer's are corrosive. Typically, corrosion resistant passivation layers are used to isolate the heating elements used to eject the droplets of ink from the ink. Unfortunately, these passivation layers reduce the efficiency with which heat is transferred from the heating element to the ink. In addition, the application of a passivation layer increases the number of manufacturing steps required to produce a heating element. Furthermore, the passivation layer may not bond properly to the underlying structures and break loose from the heating element. Thus, prior art heating elements suffer from both passivation and cavitation associated problems that tend to damage the resistive heating elements over time.

Therefore, a need exists for an ink jet printhead that has durable resistive heating elements that more efficiently transfer energy from the heating element to the ink during a printing operation.

SUMMARY OF THE INVENTION

The foregoing and other needs are met by a printhead for an ink jet printer having a heating element on a semiconductor chip. The heating element expels droplets of ink from a nozzle on a nozzle plate that is attached to the chip by vaporizing a volume of ink in contact with a surface of the chip. The heating element includes a resistive heating element that increases in temperature and vaporizes the volume of ink when a voltage is applied to the resistive heating element. A diamond-like-carbon (DLC) island is positioned over the resistive heating element. The DLC island is substantially surrounded by a material, such as aluminum, that has a lower thermal conductivity than the DLC island.

The above described embodiment improves upon the prior art in a number of respects. First, by replacing both the cavitation and passivation layers of prior art ink jet heating elements with a single layer of DLC, the invention takes advantage of the exceptionally hard and inert nature of DLC and requires less steps to manufacture. In addition, by surrounding the DLC with a material that has a lower thermal conductivity than DLC, the present invention lowers the energy consumption of the heating element by reducing heat dissipation to the area surrounding the chip and, thus, minimizes the problems associated with over heating of the chip. Furthermore, in the preferred embodiment, a smoothing layer of tantalum insures that nucleation of the ink occurs at the superheat limit.

In another aspect, the invention provides an apparatus for expelling droplets of ink onto a printing surface. The apparatus includes a semiconductor substrate having a first insulating layer deposited over the substrate. A thin resistive heating layer is then deposited over the first insulating layer. A metal conductor layer is deposited over the thin resistive heating layer and a portion of the metal conductor is removed to expose a portion of the thin resistive heating layer. A DLC island is deposited over the exposed portion of the thin resistive heating layer such that the outside perimeter of the DLC island partially overlaps the metal conductor layer. Finally, a second insulating layer is deposited over the metal conductor layer and a portion of the second insulating layer is removed such that all of the metal conductor layer and the outside perimeter of the DLC island are covered by the second insulating layer. This second insulating layer is preferably constructed from an intermetallic dielectric material (IMD). Such IMD materials include but are not limited to silicon nitride, silicon oxide, spun on glass and combinations thereof. A particularly preferred IMD is silicon oxide/spun on glass/silicon oxide.

The DLC island of the above discussed embodiment provides the previously discussed advantages of having a DLC passivation and cavitation protection layer. In addition, the second insulating layer protects the metal conductors from the corrosive effects of the ink and prevents current from leaking from the conducting layer into the ink. Thus, the invention substantially improves upon the prior art ink ejecting devices.

In yet another aspect, the invention provides a heater for expelling ink from a nozzle of an ink jet printer. The heater includes a DLC island deposited thereon. The DLC island is substantially surrounded with a material that has a lower thermal conductivity than the DLC island. A surface portion of the DLC island that comes into contact with the ink is doped with boron to provide a resistive heating portion. Metal contact portions apply a predetermined voltage to the doped surface portion of the DLC island such that a volume of ink in contact with the surface portion is vaporized.

Constructing the resistive heating portion of a heater out of a doped portion of the DLC island decreases the number of manufacturing steps required to construct a heater for an ink jet printer. In addition, the use of DLC provides the cavitation and passivation advantages of DLC previously discussed. Similarly, the surrounding of the DLC island with a material that has a lower thermal conductivity than DLC decreases the energy required to eject a droplet of ink by reducing the amount of heat dissipating laterally from the perimeter of the heater. Therefore, a number of advantages over the prior art are provided by the present invention.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows:

FIG. 4(*b*) is a graphical representation of the heat flow in a heating element of a printhead heater chip that has a DLC island on the heating element, the DLC island being surrounded by a material with a lower thermal conductivity than DLC;

FIG. 5(*b*) is a graph of normalized jetting performance versus heater energy for an embodiment of the present invention;

FIG. 6(*b*) is a graph of the droplet mass versus the nozzle exit diameter for an embodiment of the present invention.

DETAILED DESCRIPTION OF THE INVENTION

Figure 1:
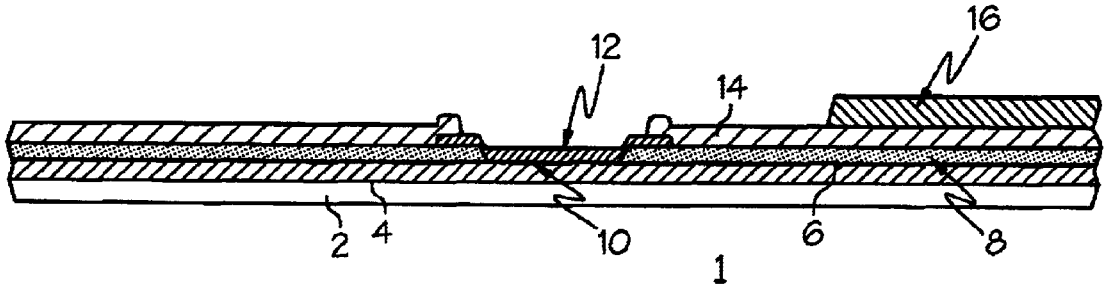
FIG. 1 is a cross-sectional view, not to scale, of a portion of a printhead heater chip containing a heating element constructed in accordance with a preferred embodiment of the present invention.

Referring now to the figures, preferred embodiments of a heater chip containing heating elements of the present invention are shown. Each of the heater chips is made using conventional semi-conductor manufacturing processes such as chemical vapor deposition (CVD), sputtering, spinning, physical vapor deposition (PVD), etching and the like. Referring now to FIG. 1, the heating element 1 is constructed upon a substrate 2. Preferably, the substrate 2 is a silicon substrate commonly used in the manufacture of ink jet printer heater chips. An insulating layer 4 is then deposited over the surface of the substrate 2 using a CVD or PVD process or thermal oxidation. This insulating layer 4 is preferably constructed of a material such as silicon nitride (SiN), silicon dioxide ($SiO_2$) or boron (BPSG) and/or phosphorous doped glass (PSG) that provides both electrical and thermal insulation between the substrate 2 and the overlying structure of the heating element 1 as described in more detail below. The insulating layer also preferably has a thickness ranging from about 8,000 to about 30,000 Angstroms (A). The insulating layer 4 improves the functioning of the heating element 1 by minimizing the amount of energy absorbed by the substrate 2 when the heating element 1 is activated. Any energy absorbed by the heating element 1 must be dissipated, otherwise, the heating element 1 may be damaged by high temperatures during long periods of operation. Therefore, it is desirable to have as high a percentage of energy as possible transferred from the heating element 1 to the ink.

A resistive layer of material 6 is deposited on top of the insulating layer 4. Preferably, the resistive material 6 includes tantalum-aluminum (Ta—Al). However, a variety of other materials such TaN, $HfB_2$, $ZrB_2$ etc. could be used to construct this 1resistive layer. The resistive layer of material 6 is used to provide a thin film firing resistor 10. The resistive layer of material 6 preferably has a thickness ranging from about 800 A to about 1600 A. The thin film firing resistor 10 is created by depositing a conductive metal layer 8 on top of the resistive layer 6. The conductive metal layer 8 preferably has a thickness ranging from about 4000 A to about 15,000 A. A portion of the conductive metal layer 8 is etched off of resistive layer 6 in the desired location of the heater resistor to provide a thin film firing resistor 10. Current is carried to the thin film resistor 10 by the low resistance metal layer 8 attached to resistive layer 6. However, in the region where the metal layer 8 has been etched away, the current primarily flows through the relatively higher resistance layer 6, thereby heating up the resistive layer 6 to provide thin film resistor 10.

A DLC island 12 is then formed over the thin film resistor 10. The DLC island 12 can be formed by depositing a DLC layer on the thin film resistor 10 and conductive metal layer 8. The DLC layer is then etched away to form the island 12 substantially only over the thin film resistor 10. Alternatively, the DLC island 12 could be controllably deposited on the thin film resistor 10 in its final island form. The DLC island 12 is derived from a diamond-like material because diamond is both electrically insulative and thermally conductive. Usually, materials that have a high thermal conductivity are electrically conductive as well. However, diamond is unique in that it is an excellent electrical insulator and has the highest thermal conductivity of any known material. DLC typically has a thermal conductivity in the range of 1000–2000 watts per meter-kelvin. The DLC island 12 preferably has a thickness ranging from about 3000 A to 12,000 A.

Figure 4A:
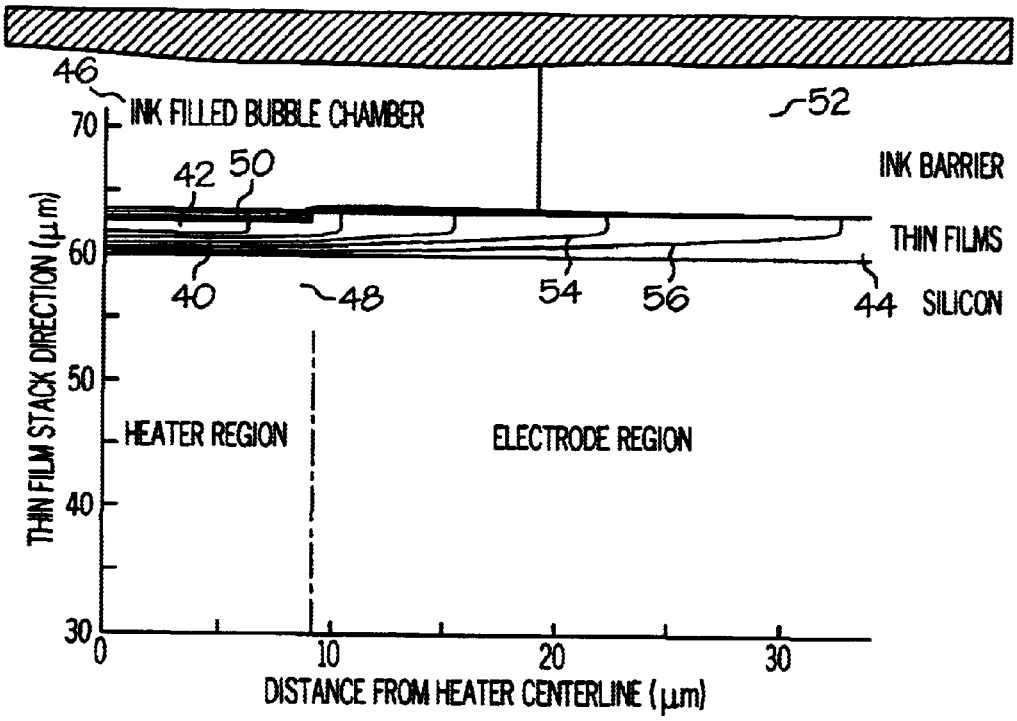
FIG. 4(*a*) is a graphical representation of the heat flow in a heating element having a continuous DLC overcoat over the surface of the printhead heater chip.
Figure 4B:
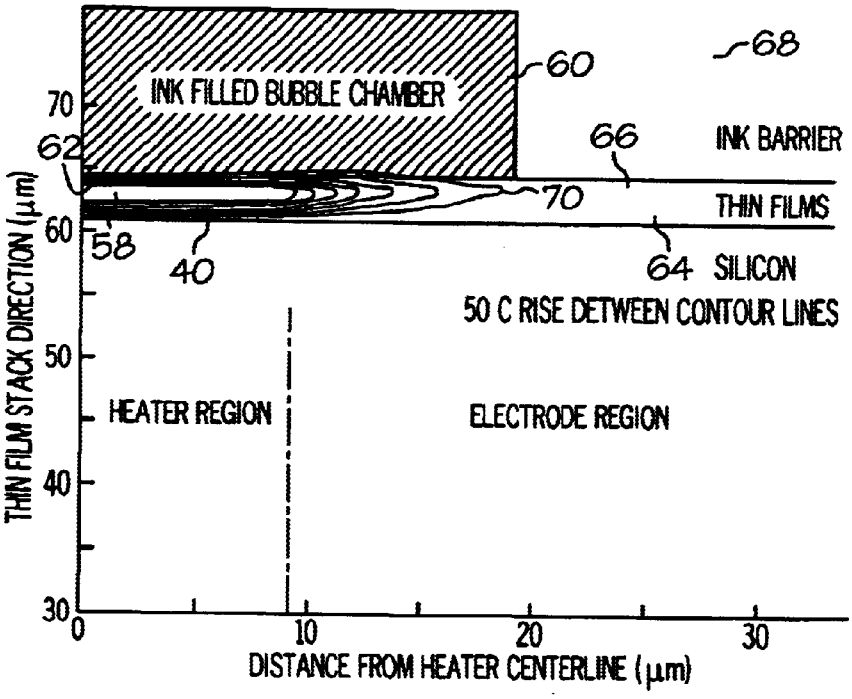

The DLC island 12 is preferably surrounded by a thermal insulation layer 14 constructed out of a material that has a lower thermal conductivity than the DLC. Preferably, the thermal conductivity of this thermal insulation layer 14 is between 1 and 20 w/m-K. However, it will be readily appreciated by those skilled in the art that any material having a thermal conductivity significantly less than the DLC may be used to minimize the heat transfer from the DLC to the surrounding materials adjacent the thin film resistor 10. The insulation layer 14 preferably has a thickness ranging from about 5,000 A to 20,000 A. The primary purpose of layer 14 is three fold. First of all, layer 14 provides dielectric isolation between conductive layers 8 and 16. Secondly, it provides chemical protection to keep the ink from attacking the conductor 16. Lastly, layer 14 is a thermal insulator that prevents lateral thermal diffusion at the edge of DLC island 12. Conductor 16 may be protected from attack by the ink by depositing a layer of corrosion resistant material such as silicon nitride, silicon dioxide, spun on glass, or a laminated polymer thereon. It is possible to expel an ink drop having a mass of between 2 and 4 nanograms (ng) with a heating element such as shown in FIG. 1 while consuming less than 1 micro-joule (j) of energy per fire as long as the thickness of the DLC island does not exceed 8700 Angstroms (A). However, if the DLC layer 12 extended everywhere instead of just layer 14, lateral diffusion would decrease the efficiency of element 1, as shown in FIG. 4(*a*).

The heating element 1 of FIG. 1 is completed by the deposition of a metal layer 16 over the thermal insulation layer 14. The metal layer 16 is electrically connected to conductive layer 8 to provide electrical pulses from a printer controller to the thin film resistor 10. The metal layer 16 preferably has a thickness ranging from about 4,000 A to 15,000 A.

The configuration of FIG. 1, referred to in the art as the heater stack, is an improvement over the prior art in a number of important respects. For example, the DLC island 12 protects the thin film resistor 10 from the corrosive effects of the ink used by the ink jet printer. DLC films are inert with respect to both acid and alkali solutions. Thus, they provide ideal corrosive protection for the thin film resistor 10. In addition, the surface of a DLC film is extremely hard. When a volume of ink is nucleated to produce a bubble of vapor, the bubble lasts for a very short amount of time and then the ink forcefully collapses onto the heating element's surface. This is known in the art as cavitation. This cavitation can cause damage such as pitting or cracking of the surface upon which it occurs. Diamond's exceptional hardness minimizes damage due to cavitation and, thus, increases the reliability and lifespan of the heating element.

Figure 2:
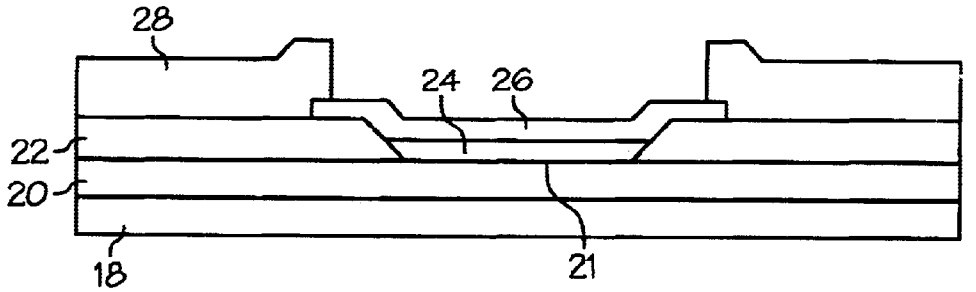
FIG. 2 is a cross-sectional view, not to scale, of a portion of a printhead heater chip containing a heating element constructed in accordance with another embodiment of the present invention.

An alternative embodiment of the present invention is shown in FIG. 2. In FIG. 2, the heating element is once more provided on a silicon substrate 18. An electrically and thermally insulating layer 20 as described above with reference to FIG. 1 is deposited on the silicon substrate 18. This insulating layer 20 is preferably constructed of silicon dioxide ($SiO_2$). However, it will be readily appreciated by those skilled in the art that a variety of materials could be used for the insulating layer 20. A metal layer 22, preferably constructed of aluminum (Al), is deposited over the insulating layer 20. The function of the metal layer 22 is to provide a low resistance path for current to flow to the heating element. The metal layer 22 preferably has a thickness ranging from about 4000 A to about 15,000 A. A portion of the metal layer 22 is etched away to provide a location for a partially doped DLC island that is deposited on insulating layer 20 such that it partially overlaps the metal layer 22.

The DLC island 21 is then deposited in the etched away area of the metal layer 22. The DLC island 21 consists of an upper portion 26 and a lower portion 24 which is preferably doped with boron to provide a conductive path having a sheet resistance between 25 and 100 ohms per square. However, it will be readily appreciated that the particular material used to dope the lower portion 24 of the DLC island 21 and the resistance of the doped portion 24 can be selected depending upon the desired operating parameters of the DLC island 21 used as a heater resistor. The exposed portions of the metal layer 22 are then preferably covered with a layer 28 of silicon nitride (SiN), silicon-dioxide ($SiO_2$), spun on glass (SOG) or other intermetallic dielectric material (IMD) that functions to electrically and physically insulate the metal layer 22 from the ink. The IMD layer 28 preferably has a thickness ranging from about 5000 A to about 20,000 A.

The configuration of the heating element shown in FIG. 2 utilizes the doped portion 24 of the DLC island 21 as the firing resistor of the heating element. To function as a firing resistor, the portion 24 is doped such that it has a relatively higher resistance than the metal layer 22. Thus, when current is forced to flow through the higher resistance doped portion 24, a relatively large amount of power is dissipated and the surface of the doped portion 24 rapidly heats up. The rapid heating up of the doped portion 24 nucleates a volume of ink that is in contact with the surface of the DLC island 21. Thus, the doped portion 24 of the DLC island 21 functions as a firing resistor for the heating element of FIG. 2. Portion 24 may be doped, for example, by feeding boron gas into the deposition chamber during the initial formation process for the DLC island 21 to provide doped portion 24, then terminating the introduction of boron gas during the final DLC island 21 formation process to provide undoped portion 26. In the alternative, the doped portion 24 may be made by implanting boron in a first DLC island layer portion 24 and then depositing a second DLC island portion 26 on top of the doped portion 24. The overall thickness of the DLC island 21 preferably ranges from about 3000 A to 12,000 A. The thickness of the lower doped portion 24 preferably ranges from about 500 A to 1000 A.

The DLC island 21 construction of FIG. 2 is beneficial due to the above discussed cavitation and corrosion benefits obtained by having the ink nucleating surface constructed out of a DLC material. The construction of FIG. 2 is further beneficial in that the DLC island 21 is surrounded by a metal layer 22 that has a lower thermal conductivity than the DLC island 21. Thus, the heat produced by the doped portion 24 is efficiently transferred to the ink without a large amount of energy loss to the structure of the heating element. While the metal layer 22 is preferably constructed of aluminum, aluminum copper, aluminum silicon, or copper that has a thermal conductivity in the range 200 w/m-Kelvin, it is readily appreciated that any material having a thermal conductivity less than DLC material and an electrical conductivity greater than DLC will provide beneficial heat transfer and current flow results when used to surround the DLC island 21.

The use of the doped portion 24 of the DLC island 21 as the firing resistor of the heating element simplifies the construction of the heating element. Thus, the heating element of FIG. 2 requires less manufacturing steps than the heating element 1 of FIG. 1 to produce. Reducing the number of steps required to produce the heating element of an ink jet printhead reduces the cost of manufacturing the printhead cartridge and decreases the likelihood of a manufacturing defect. Thus, the structure of FIG. 2 is a substantial improvement upon the prior art.

Figure 3:
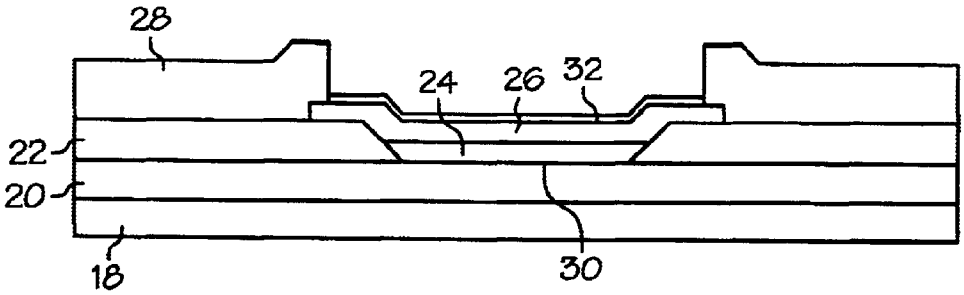
FIG. 3 is a cross-sectional view, not to scale, of a portion of a printhead heater chip including a heating element constructed in accordance with yet another embodiment of the present invention.

Yet another embodiment of the present invention is graphically represented in FIG. 3. The heating element of FIG. 3 differs from the heating element of FIG. 2 in that it has a smoothing layer of material 32 deposited on top of the upper portion 26 of the DLC island 30. The function of this thin coating 32 is to reduce the surface roughness of the DLC island 30 to less than 75 A. In the preferred embodiment, the smoothing layer 32 is constructed of tantalum due to its ability to be smoothly deposited and its resistance to the cavitation and corrosion effects discussed above. However, it is readily appreciated by the present inventors that a variety of materials, such as titanium (Ti), tungsten (W), titanium-tungsten (TiW), platinum, or any other refractory like material, could be used to construct this smoothing layer 32.

The purpose of the smoothing layer 32 is to insure that vaporization of the ink occurs at the superheat limit of the ink. The superheat limit of a liquid is the temperature above which the liquid can no longer exist as a liquid at atmospheric pressure. While the superheat limit of any particular ink will depend upon the composition of the ink, the superheat limit for an ordinary ink jet printer ink is in the vicinity of 322–332 Celsius (C). Ordinary nucleate boiling of the ink typically occurs at temperatures much lower than the superheat limit. However, it is recognized by the present inventors that nucleate boiling of a liquid initiates at surface defects on the surface of the heating element. Thus, to insure that vaporization occurs at the superheat limit, the surface of the heating element that is in contact with the ink should be as smooth as possible. A surface roughness less than 75 A is generally sufficient to insure that vaporization occurs at or near the superheat limit. While it is possible to deposit a DLC film with a surface roughness of less that 75 A, there may be situations where the embodiment of FIG. 3 is more ink and cavitation resistant than the embodiment of FIG. 2 wherein the surface of DLC island 21 is in direct contact with the ink. The smoothing layer can also be applied to the embodiment of FIG. 1.

The embodiments of FIGS. 1–3 all utilize a DLC island that is surrounded by a material having a lower thermal conductivity than DLC. This is because DLC material has such a high thermal conductivity that a large amount of thermal energy will be diffused into the region outside resistor 10 if the DLC material is deposited over the printhead in a continuous layer. This dissipation effect can be seen by examining the temperature plots of FIGS. 4(*a*) and 4(*b*). FIG. 4(*a*) is a graphical representation of the temperature of a heating element during firing that has a continuous DLC coating on top of the firing resistor. Conversely, FIG. 4(*b*) is a graphical representation of the temperature of a heating element during firing that has a DLC island, such as depicted in FIGS. 1, 2 or 3, on top of the firing resistor. The graphs of FIGS. 4(*a*) and 4(*b*) represent a cross section of the respective heating elements. A 50 degrees Celsius (C) temperature rise is represented by each of the temperature contour lines 40.

Referring now to FIG. 4(*a*), the temperature contour lines 40 for a heating element having a DLC overcoat are shown. The highest temperature area 42 of the heating element is in the thin film region 44 under the ink filled bubble chamber 46. The temperature in the thin film region 44 located under the ink filled bubble chamber 46 drops off rapidly toward the supporting silicon substrate 48. This indicates that relatively little thermal energy is passing from the thin film region 44 to the silicon substrate 48. This is a result of the relatively good thermal insulation properties of the $SiO_2$/BPSG layer that was discussed earlier in regards to layer 4 of FIG. 1. The ideal situation would involve 100% of the heat being transferred from the thin film region 44 to ink filled bubble chamber 46. The temperature contour lines 50 clearly indicate that a relatively large amount of thermal energy is being transferred from the thin film region 44 to the ink filled bubble chamber 46. Thus, a large amount of energy is available at the surface of the DLC overcoat for superheating the ink in the ink filled bubble chamber 46.

FIG. 4(*a*) also clearly shows that the thin film region 44 that includes the protective DLC overcoat is carrying a large amount of thermal energy away from the ink filled bubble chamber 46 to a region that is located under the ink barrier 52. This is primarily represented by the temperature contour lines 54 and 56. This large amount of lateral heat diffusion is a result of the DLC having diamond-like thermal conductivity. Diamond's thermal conductivity is the highest of any known material. Thus, the thin films 44, which include the DLC overcoat, act to transfer heat away from the ink filled bubble chamber 46 to the region of the thin films 44 that is located under the ink barrier 52. This excess lateral heat transfer drains thermal energy away from the bubble chamber 46. Thus, more energy needs to be added for each droplet ejection cycle which causes the operating temperature of the print head to rise. If the temperature rise is large enough, the heating element may be damaged by this excess heat over time. Additionally, operating the print head at excessively high temperatures leads to poor droplet ejection characteristics, such as nozzle plate flooding, air devolution and droplet mass variation.

FIG. 4(*b*) shows the temperature contour lines 40 for a heating element that utilizes a DLC island placed substantially only over the heating resistor. The highest temperature area 58 is located directly below the ink filled bubble chamber 60. Furthermore, the close spacing of the temperature contour lines 40 at the thin film surface 62 clearly indicates that a large amount of heat is being transferred to the ink in the bubble chamber 60. The benefits of a thin film stack 64 that includes a DCL island can be seen from examining the thin film region 66 under the ink barrier 68. Unlike the temperature contours 54 and 56 of FIG. 4(*a*), the first contour line 70 of FIG. 4(*b*) barely extends to the border of the ink barrier region 68. Thus, the amount of thermal energy being laterally diffused through the thin films 64 is greatly reduced by surrounding the DLC that is used to overcoat the firing resistors with a material that has a significantly lower thermal conductivity than DLC. As previously discussed, the reduced thermal diffusion resulting from the use of DLC islands is an improvement in that it increases the operating efficiency of the heating elements and minimizes the temperature rise of the heating elements under operating conditions.

A heating element that uses a DLC island to overcoat the firing resistor of the heating element of an ink jet printer requires less energy to fire than a prior art heating element. The precise amount of energy required to eject a droplet of ink depends upon a number of factors. For example, the energy required to fire an ink droplet depends on the heater area, the heater stack thickness, the heater stack materials and properties and the super heat limit of the ink. The heater area and nozzle size depend upon the mass of the ink droplet to be ejected. One particular factor that affects the amount of energy required to eject a drop of ink with a heating element constructed in accordance with the present invention is the thickness of the DLC island. While the actual numbers will depend upon the particular device, a representative graph of required heater input energy values 72 for a range of DLC island thicknesses 74 for a particular heating element is set forth in FIG. 5(*a*). The heating element from which the data of FIG. 5(*a*) is derived is a preferred embodiment of the present invention that has a DLC island overcoating a thin film resistor with an area of approximately 306 $\mu m^2$. The 306 $\mu m^2$ heating element of FIG. 5(*a*) is designed to eject an ink droplet having a mass of 2–4 ng. With these limitations, six data points 76, 78, 80, 82, 84 and 86 are plotted in FIG. 5(*a*) from which a theoretical line 88 of results is derived. As can be seen from FIG. 5(*a*), the lower the DLC overcoat thickness 74, the lower the amount of heater energy 72 required to eject the ink droplet. For example, data point 78 indicates that slightly more than 0.4 $\mu$j of energy are required to eject a droplet of ink when the overcoat thickness is approximately 0.2 $\mu$m. However, data point 86 indicates that 1.0 $\mu$j of energy is required when the overcoat thickness is approximately 0.87 $\mu$m. Since it is desirable to have the energy consumed per fire be as low as possible, FIG. 5(*a*) indicates that the DLC Overcoat should be made as thin as possible. The present inventors have discovered that the best overall mix of commercial results are achieved when the DLC overcoat is less than approximately 8700 A in thickness and the energy consumed per fire is less than 1.0 $\mu$j.

Figure 5A:
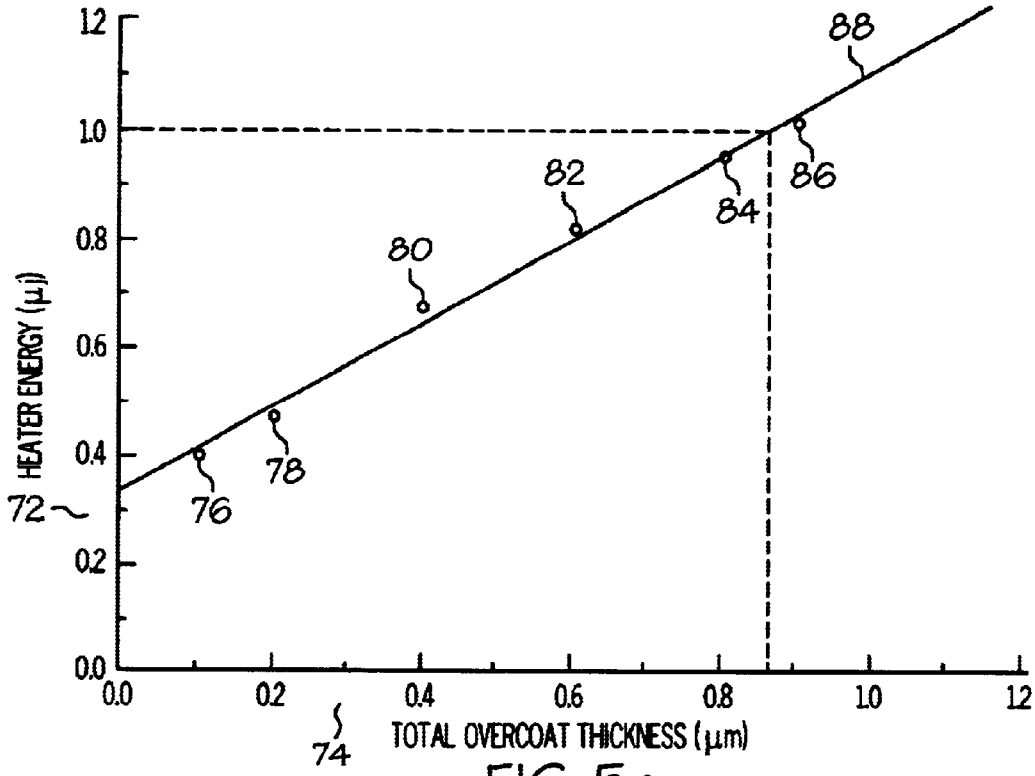
FIG. 5(*a*) is a graph of the heater energy in $\mu$joules required to expel a droplet of ink versus DLC overcoat thickness in $\mu$meters for an embodiment of the present invention.
Figure 5B:
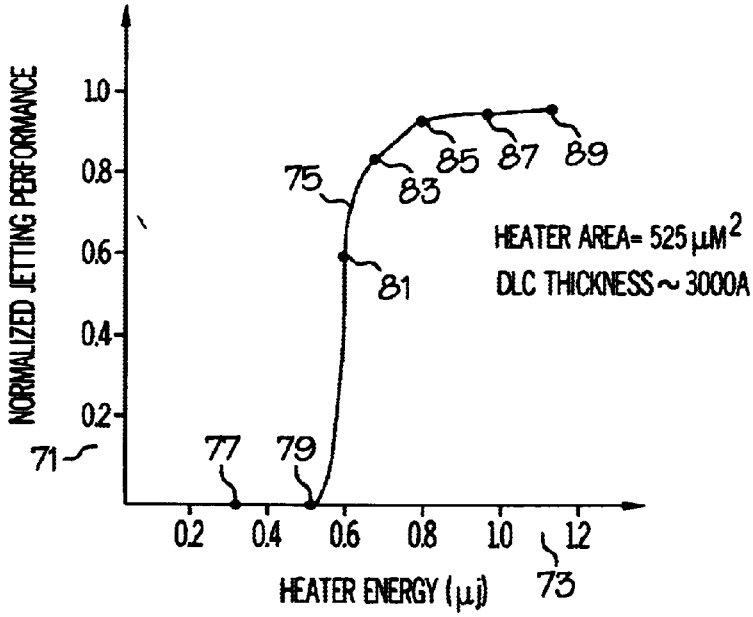

FIG. 5(*b*) shows the jetting performance as a function of normalized ejection velocity 71 versus heater energy 73 for a heater that is 525 $\mu m^2$ in area with 3000 A of DLC in the style typified by FIG. 1. The graph shows a curve 75 that is fit to a number of data points 77, 79, 81, 83, 85, 87 and 89. The first data point 77 indicates that the heater energy of approximately 0.3 $\mu$j is not sufficient to eject a droplet from the heater. Data point 79 indicates that a minimum of approximately 0.5 $\mu$j is required to eject a droplet of ink from the heater. Once more than 0.5 $\mu$j of energy is applied to the heater, the velocity of the ejected droplet rises rapidly as can be seen from examining data points 81, 83 and 85. As can be determined from examining data points 85, 87 and 89 on FIG. 5(*b*), applying more than 0.8 $\mu$j of energy to the heater does not significantly increase the velocity of the ejected droplet. Thus, stable droplet ejection can be achieved with just 0.8 $\mu$j of energy when using a heater having an area of 525 $\mu$m and a DLC thickness of approximately 3000 A. The ejected droplet at this stable level has a mass of about 7 to 10 nanograms and a velocity greater than 500 inches/second.

The exit diameter of the nozzle will also affect the velocity with which the droplet of ink is expelled. A relatively high velocity ink droplet is preferred in that it helps overcome the formation of viscous plugs in the nozzles due to evaporation of the water in the ink. More particularly, it has been determined that a droplet velocity of at least 500 inches per second substantially overcomes the formation of viscous plugs and produces a good quality image. Furthermore, for grain free printing, it is particularly preferred to have a droplet mass between 2–4 ng. Because a larger number of more closely packed heating elements are typically required to produce a higher resolution image, the energy consumption of the heating elements must be limited to prevent the heater chip from being damaged by an excessive rise in temperature during operation. An energy consumption of approximately 1 $\mu$j per fire is large enough to expel a 2–4 ng ink droplet from the above discussed DLC heating elements yet small enough to prevent an unacceptable temperature rise in the heating element. As discussed below, these preferred operating parameters can be used to determine a preferred nozzle exit diameter.

Figure 6A:
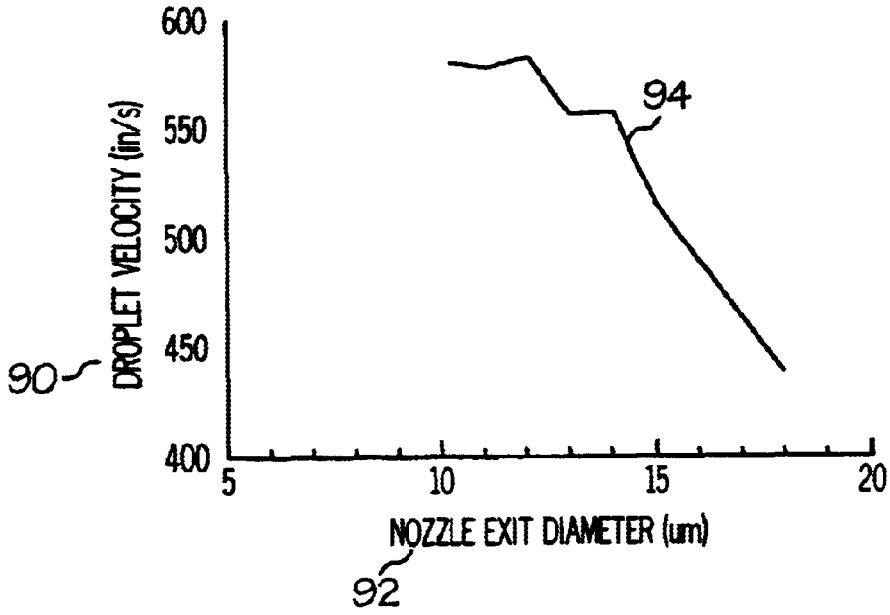
FIG. 6(*a*) is a graph of the droplet velocity versus the nozzle exit diameter for an embodiment of the present invention.
Figure 6B:
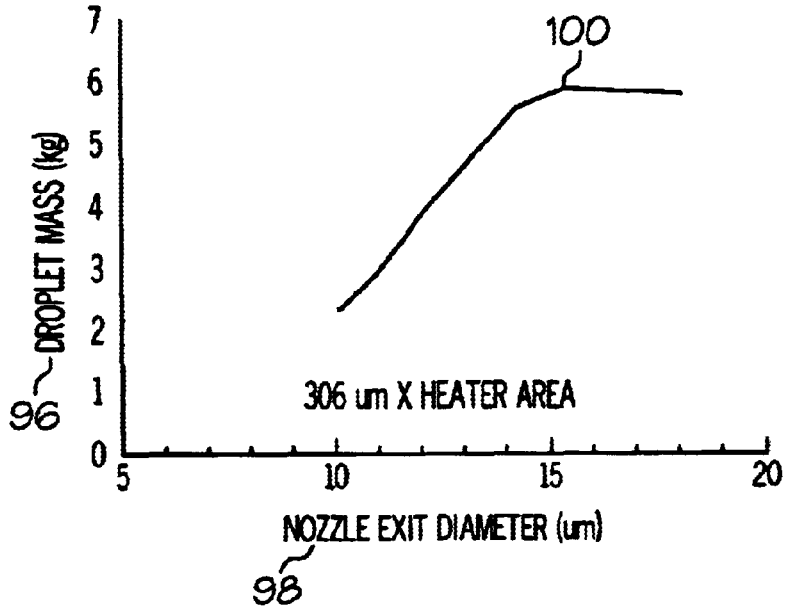

FIG. 6(*a*) is a graph of droplet velocity versus nozzle exit diameter for a given heating element having a given set of operating parameters. In particular, the graph of FIG. 6(*a*) was determined for a DLC heater having an area of 306 $\mu m^2$ that is designed to consume approximately 1 $\mu$j or less of energy per fire. The line 94 represents the droplet velocity 90 for a given range of nozzle exit diameters 92. As can be seen by examining the line 94, the droplet velocity 90 decreases as the nozzle exit diameter increases 92. This relationship holds true until the nozzle exit diameter 92 is so large that no droplet of ink is expelled at all. By examining FIG. 6(*a*), it can be determined that, for the particular heating element construction represented in FIG. 6(*a*), the desired ink drop velocity of 500 inches per second is achieved whenever the nozzle exit diameter is less than approximately 15 $\mu$m.

FIG. 6(*b*) is a graph of the mass of an ink droplet 96 expelled versus the exit diameter of the nozzle 98 used to expel the drop of ink for the heating element of FIG. 6(*a*). FIG. 6(*b*) clearly indicates that, for the given heating element having the given set of operating parameters, the droplet mass 96 increases when the nozzle exit diameter 98 increases. This proportional relationship is maintained until the droplet mass is increased to a point 100 where the particular heating element is expelling the largest possible ink droplet for its given operating parameters. Knowing that it is desirable to have a droplet mass between 2 and 4 ng and a droplet velocity greater than 500 inches per second, the appropriate nozzle exit diameter can be determined by examining the graphs of FIGS. 6(*a*) and (*b*). Referring first to FIG. 6(*b*), a nozzle diameter of between 10–12 $\mu$m results in a droplet mass of between 2–4 ng. Furthermore, referring now to FIG. 6(*a*), a nozzle exit diameter less than 15 $\mu$m will result in a droplet velocity greater than 500 inches per second. Thus, a preferred DLC heating element having an area of 306 $\mu$m will consume approximately 1 $\mu$j or less of energy to expel a 2–4 ng ink droplet of ink with a velocity greater than 500 inches per second if the nozzle exit diameter is between 10–12 $\mu$m. A similar process can be used to determine the nozzle exit diameter for any particular heating element.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A printhead for an ink jet printer, the printhead having a heating element on a semiconductor chip for expelling droplets of ink from a nozzle of a nozzle plate attached to the chip by vaporizing a volume of ink in contact with a surface of said heating element, said chip comprising:

a resistive heating element wherein said resistive heating element increases in temperature and vaporizes said volume of ink when a voltage is applied to said resistive heating element; and a diamond-like-carbon island positioned over said resistive heating element wherein said diamond-like-carbon island is substantially surrounded by a material having a lower thermal conductivity than said diamond-like-carbon island sufficient to reduce heat dissipation to an area surrounding the resistive heating element.

2. The printhead of claim 1 wherein said diamond-like-carbon island is less than 8700 angstroms in thickness.

3. The printhead of claim 1 wherein a surface of said diamond-like-carbon island that comes into contact with said ink has a surface roughness less than 75 angstroms.

4. The printhead of claim 1 wherein said resistive heating element is formed on a silicon substrate containing a silicon dioxide ($SiO_2$) insulating layer between the substrate and resistive heating element.

5. The printhead of claim 1 wherein said diamond-like-carbon island is coated with a smoothing layer such that a surface of said smoothing layer in contact with ink has a surface roughness of less than 75 angstroms.

6. The printhead of claim 5 wherein said smoothing layer is comprised of tantalum.

7. The printhead of claim 1 wherein a surface of said diamond-like-carbon island that is in contact with said ink has a surface roughness such that vaporization of said ink occurs at a superheat limit of said ink.

8. The printhead of claim 1 wherein said nozzle has an exit diameter between 10–12 $\mu$m.

9. The printhead of claim 1 wherein said printhead is configured to eject a droplet of ink through said nozzle such that said droplet of ink has a velocity greater than approximately 500 inches per second.

10. The printhead of claim 1 wherein said resistive heating element is dimensioned to have an area of approximately 306 $\mu m^2$.

11. The printhead of claim 1 wherein said printhead is constructed such that less than 1 $\mu$j of energy is required to vaporize said volume of ink.

12. The printhead of claim 1 wherein said material surrounding said diamond-like-carbon island is aluminum.

13. The printhead of claim 1 wherein said resistive heating element comprises a doped portion of said diamond-like-carbon island.

14. The printhead of claim 13 wherein said diamond-like-carbon layer is doped with boron.

15. An apparatus for expelling droplets of ink onto a printing surface, said apparatus comprising:

a semiconductor substrate;

a first insulating layer deposited over said semiconductor substrate;

a thin resistive heating layer deposited over said first insulating layer;

a metal conductor layer deposited over said thin resistive heating layer wherein a portion of said metal conductor is removed to expose a portion of said thin resistive heating layer;

a diamond-like-carbon island deposited over said exposed portion of said thin resistive heating layer such that an outside perimeter of said diamond-like-carbon island partially overlaps said metal conductor layer; and a second insulating layer deposited over said metal conductor layer wherein a portion of said second insulating layer is removed such that all of said metal conductor layer and said outside perimeter of said diamond-like-carbon island are covered by said second insulating layer and wherein said second insulating layer is effective to reduce heat dissipation to an area surrounding the resistive heating layer.

16. The apparatus of claim 15 wherein said diamond-like-carbon island is less than 8700 angstroms in thickness.

17. The apparatus of claim 15 further comprising a smoothing layer of tantalum deposited over said diamond-like-carbon island wherein said smoothing layer has a surface roughness less than 75 angstroms.

18. The apparatus of claim 15 wherein said second insulating layer is comprised of an intermetallic dielectric material.

19. A printhead for an ink jet printer wherein said printhead expels droplets of ink from a nozzle in a nozzle plate attached to a heater chip containing heating elements by nucleating a volume of ink that is in contact with a surface of said heating element, said printhead comprising:

a resistive heating element wherein said resistive heating element rises in temperature in response to a voltage;

a diamond-like-carbon coating positioned on said resistive heating element; and a smoothing layer deposited on said diamond-like-carbon coating such that said surface of said heating element that is in contact with said ink has a surface roughness less than 75 angstroms.

20. The printhead of claim 19 wherein said smoothing layer comprises tantalum.

21. The printhead of claim 19 wherein said resistive heating element comprises a doped portion of said diamond-like-carbon coating.

22. The printhead of claim 21 wherein said doped portion is doped with boron.

23. A heater for expelling ink from a nozzle of an inkjet printer, said heater comprising:

a diamond-like-carbon island deposited on a substrate wherein said diamond-like-carbon island is substantially surrounded with a material having a lower thermal conductivity than said diamond-like-carbon island, said material being sufficient to reduce heat dissipation to an area surrounding said diamond-like-carbon island and wherein a portion of said diamond-like-carbon island is doped to provide a resistive heating portion; and metal contact portions for applying a predetermined voltage to said resistive heating portion of said diamond-like-carbon island such that a volume of ink in contact with said diamond-like-carbon island is vaporized.

24. The heater of claim 23 wherein said nozzle and said resistive heating portion are configured to expel a drop of ink having a mass in the range of 2–4 nanograms.

25. The heater of claim 23 wherein said diamond-like-carbon island has a thickness such that less than 1 microjoule is required to expel a drop of ink having a mass in the range of 2–4 nanograms.

26. The heater of claim 23 wherein a surface of said diamond-like-carbon island that is in contact with said ink has a surface roughness of less than 75 Angstroms.

* * * * *